United States Patent [19]

Tanaka et al.

[11] Patent Number: 4,923,088

[45] Date of Patent: May 8, 1990

[54] RADIATION-SHIELDING CONTAINER

[75] Inventors: Shinsuke Tanaka, Chiba; Jun Takahashi, Ichihara; Nobuo Ueda, Chiba; Hiroaki Matsushima, Nishinomiya, all of Japan

[73] Assignee: Nihon Medi-Physics Co., Ltd., Takarazuka, Japan

[21] Appl. No.: 166,981

[22] Filed: Mar. 11, 1988

[30] Foreign Application Priority Data

Mar. 11, 1987 [JP] Japan ..... 62-35557

[51] Int. Cl.[5] ..... B65D 90/04; G21F 5/00

[52] U.S. Cl. ..... 220/468; 215/1 R; 220/270; 220/408; 250/506.1

[58] Field of Search ..... 220/468, 408, 266, 268, 220/276, 83, 288, 270; 215/1 R, 256; 206/524.2; 250/506.1, 507.1

[56] References Cited

U.S. PATENT DOCUMENTS

| | | | |
|---|---|---|---|
| 2,108,212 | 2/1938 | Schellens | 220/468 |
| 2,326,414 | 8/1943 | Thompson | 215/1 R |
| 2,876,692 | 3/1959 | Gaisman | 215/1 R |
| 3,124,264 | 3/1964 | Waisberg | 215/1 R |
| 3,256,441 | 6/1966 | Grasty | 250/506.1 |
| 3,275,180 | 9/1966 | Optner et al. | 220/408 |
| 3,531,644 | 9/1970 | Koster | 250/506.1 X |
| 3,655,985 | 4/1972 | Brown et al. | 250/506.1 |
| 3,730,374 | 5/1973 | Picciano | 220/408 |
| 4,020,355 | 4/1977 | Czaplinski et al. | 250/506.1 |
| 4,081,688 | 3/1978 | Fries | 250/506.1 |
| 4,144,461 | 3/1979 | Glasser et al. | 252/506.1 |
| 4,190,175 | 2/1980 | Allen | 220/270 |
| 4,382,512 | 5/1983 | Furminger | 250/506.1 X |
| 4,673,813 | 6/1987 | Sanchez | 250/506.1 |

*Primary Examiner*—Philip R. Coe
*Assistant Examiner*—Stephen F. Gerrity
*Attorney, Agent, or Firm*—Jones, Tullar & Cooper

[57] ABSTRACT

A radiation-shielding container comprising an outer plastic tube, an inner radiation-shielding metal tube inserted into the outer tube and a top plastic cap accompanied with a plug made of a radiation-shielding metal on its back and a bottom plastic cap, wherein the top and the bottom caps attach to the uppermost and the lowermost edges, respectively of the plastic outer tube in a snap-on method or a screwed or threading method, have respectively a peripheral thin section on the curved surface and are so designed that they can not be removed from the outer tube unless the thin section of the cap is cut off or that the thin section is forcibly opened.

6 Claims, 3 Drawing Sheets

RADIATION-SHIELDING CONTAINER

BACKGROUND OF THE INVENTION

1. Field of the Invention

The present invention relates to a radiation-shielding container for use in the transportation of radio-pharmaceuticals.

2. Prior Art

Conventional containers usable in such transportation comprise a body and a cap made of a radiation-shielding metal (e.g. lead), a body and a cap made of plastic material which are linked with a radiation-shielding metal (e.g. lead). In the transportation, vials containing radiopharmaceuticals, for instance, formulated into injection solutions, are kept in the above mentioned container, and the joint portion of the body and the cap is sealed by heat or affixed by an adhesive tape so as to prevent any radiation leakage from the container.

Any container for use in the transportation of radiopharmaceuticals shall meet such requirement as non-leakage of radiation beyond tolerance. In addition, the radioactive solution should never leak out of the radiation-shielding container, and even if it would leak out of the container due to damage of the vials or the like during transportation, the radiation-shielding container must have such a mechanism so that the container is not restored to the original state once it is opened. The conventional radiation-shielding containers however do not completely satisfy these requirements.

Furthermore, in diagnostic or therapeutic facilities such as hospitals, there is a demand that the plastic portion and the metal portion of the container should be readily separable for disposal of the containers. It is to be noted that the conventional containers have a disadvantage in that the plastic portion and the metal portion of the container can not be readily separated due to the linkage with lead as mentioned above.

SUMMARY OF THE INVENTION

In order to overcome these drawbacks as seen in the conventional containers, an object of the invention is to provide an improved radiation-shielding container comprising an outer plastic tube, an inner radiation-shielding metal (e.g. lead) tube inserted into the outer tube and top and bottom plastic caps respectively attached to the uppermost and the lowermost edges of the outer tube in a snap-on method or a screwed or threading method. On the back of the top cap, there is provided a plug made of a radiation-shielding metal (e.g. lead), and the top and the bottom caps have respectively a peripheral thin section on the curved surface and are so designed that they can not be removed from the outer tube unless the thin section of the cap is cut off or that the thin section is forcibly opened. Furthermore, provision of a peripheral ridge on either of the plastic members can prevent the unsteady state of the metal tube and permits each plastic member to get into close contact with each other.

BRIEF DESCRIPTION OF THE DRAWINGS

The present invention will be illustratively shown in conjunction with the accompanying drawings wherein.

DETAILED DESCRIPTION OF THE PREFERRED EMBODIMENTS

Figure 1:
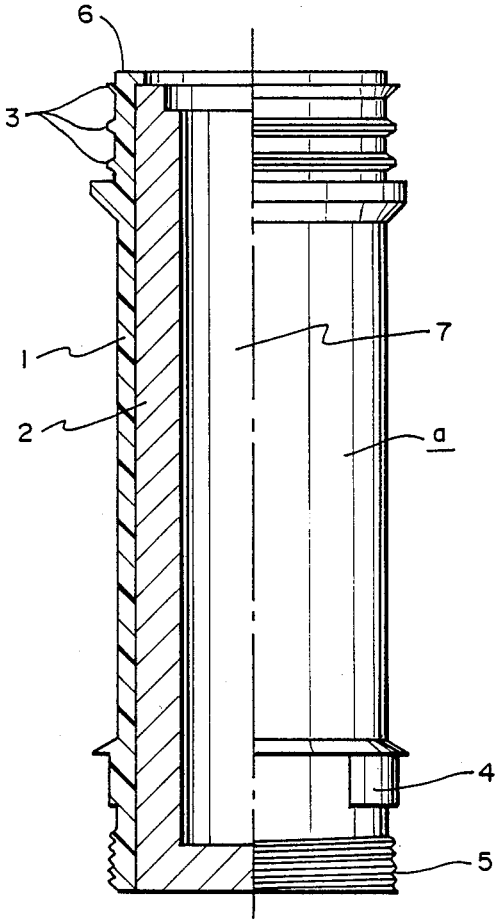
FIG. 1 shows a front partial sectional view of the radiation-shielding container according to the present invention.
Figure 2:
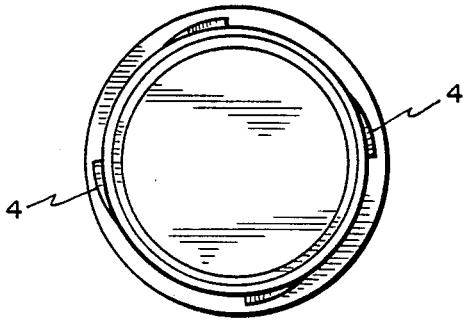
FIG. 2, is a bottom view of the container of FIG. 1.

Referring to the drawings, the embodiment of the invention is described further in detail. Namely, FIG. 1 shows a radiation-shielding container a comprising an inner metal tube 2, of which the upper portion is open-ended and the bottom portion is closed, and an outer plastic tube 1 having two-open ends. The metal tube 2 is freely detachable from the plastic tube 1 and is preferably prevented from protruding from the latter by a stopper 6 provided on the inner top edge of the plastic tube 1. Into a cavity 7 of the metal tube 2, a vial or a syringe-type container filled with a radiopharmaceutical is inserted together with a shock absorbing material for prevention of breakage within the tube 2.

Figure 3:
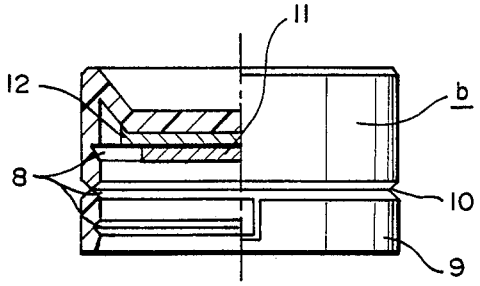
FIG. 3 shows a front partial sectional view of the top cap according to the present invention.

On the curved surface of the upper opening portion of the plastic tube 1, there is provided at least two peripheral ridges 3 (three ridges in the drawing), to which a top plastic cap b is to be attached in a snap-on method by engagement with the corresponding grooves 8 (three grooves in the drawing) on the inner periphery of the top cap b. (FIG. 3). At the lower portion of the plastic tube 1, there is provided a plurality of wedge-type protrusions 4 (four protrusions in the drawing) on the curved surface and an external thread 5 at the uppermost portion on the curved surface, to which a bottom plastic cap (FIG. 5) is to be attached in a screwed or threading manner.

In FIG. 3, a plug 11 made of a radiation-shielding metal (e.g. lead) is fixed on the back of the top cap b by a stopper 12 to prevent leakage of radiation out of the vial or container. In order to assure non-leakage of radiation, the plug 11 is so molded as to exactly correspond to the opening section of the metal tube 2. With this construction, the top cap b is hardly detachable from the metal tube 2. On the other hand, opening of the top cap b from the plastic tube 1 is achieved by tearing a lower portion of the cap b. Namely, the side wall of the top cap b is separable at a lengthwise ridge 9' and a peripheral groove 10 into two parts, the lower part of which is called a skirt 9. Along the lengthwise ridge 9', there is provided a grip 9'' on the curved surface of the cap b and pulling-out of the grip 9'' results in breakage of the skirt 9 at the ridge 9' and then along the peripheral groove 10 for split up of the skirt 9 from the upper portion of the cap b, followed by pulling up a protrusion b' provided on the curved surface of the cap b to the cap b. However, once the cap b is opened, it can not be restored to its original shape and thus is not reusable.

Figure 5:
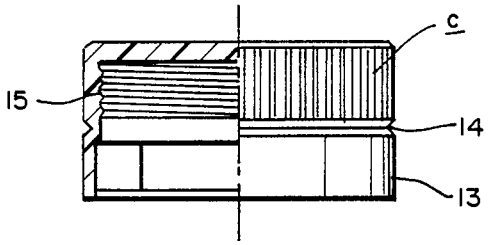
FIG. 5 shows a front partial sectional view of the bottom cap according to the present invention.
Figure 4:
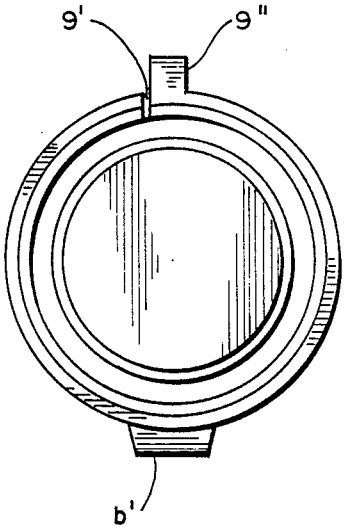
FIG. 4 is a bottom view of the cap of FIG. 3.
Figure 6:
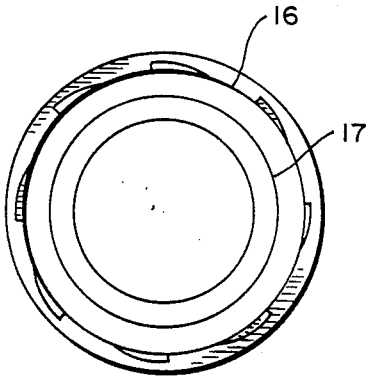
FIG. 6 is a bottom view of the cap of FIG. 5.

In FIG. 5, on the inside upper periphery of the bottom cap c, there are provided an internal thread 15 corresponding to the external thread 5 on the plastic tube 1 and a plurality of wedge-type protrusions 16 (eight protrusions in the drawing) on the lower inside periphery. The bottom cap c is also separable into two portions, i.e. an upper part and a lower part (i.e. skirt 13), at a pheripheral groove 14 of thin section like the groove 10 on the top cap b. To attach the bottom cap c to the plastic tube 1, the external thread 5 is fitted to the internal thread 15, followed by moving the cap c toward the screw direction, whereby, due to elasticity of skirt 13, the wedge-like protrusion 16 moves over the external thread 5 to reach the wedge-like protrusion 4. Continuous movement of the cap c in this way permits the plastic tube 1 to get into tight contact with the bottom cap c. On the other hand, when the cap c proceeds backward, the wedge-like protrusions 4 and 16 prevent movement. When the cap c is forcibly moved, the peripheral groove 14 is cut and the skirt 13 is detached from the cap c. As the result, a cap c can easily proceed backward and opening of the cap c is thus performed. However, once the cap c is opened, it can not be restored to its original shape and thus is not re-usable. The provision of a peripheral ridge 17 at the back of the cap c can assist a tight contact of the cap c with the lowermost edge of the plastic tube 1, thereby preventing the unsteady state of the metal tube 2 in the cavity 7 and also assuring the tight contact of the tube 2 with the cap c.

As is illustrated above, the present invention provides an improved radiation-shielding container which satisfies the essential requirements such as tight contact of each member and non-restorability of the container once it is opened. Moreover, the container of the invention is practically advantageous as it can be readily separable into the inner metal tube and the outer plastic tube with detachment of the bottom cap. Likewise, the metal plug fixed on the top cap can be readily removable by slight deformation due to the elasticity of the plastic material constituting the cap.

Figure 7:
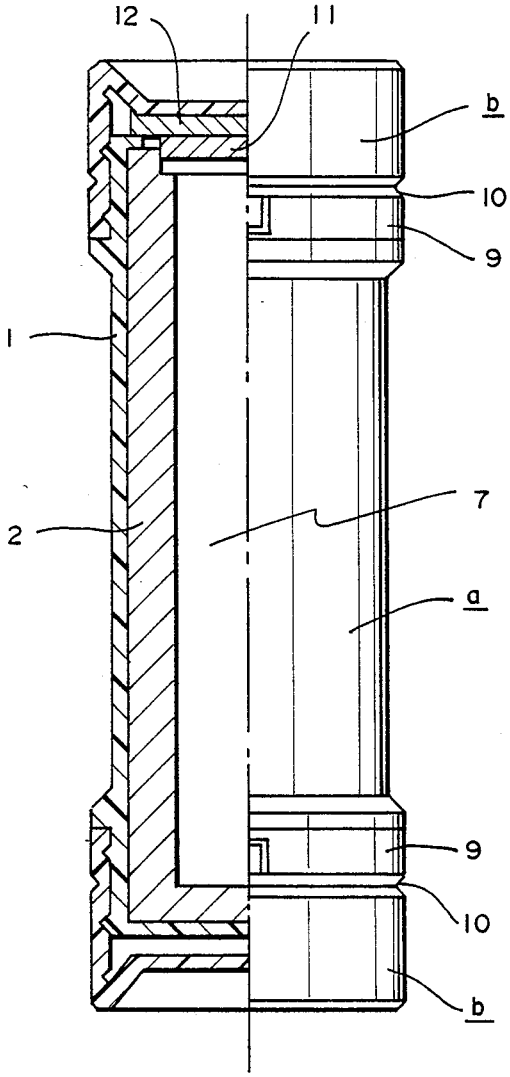
FIG. 7 is a partial sectional view of the radiation-shielding container with the top and bottom caps attached thereto by the snap-on method.
Figure 8:
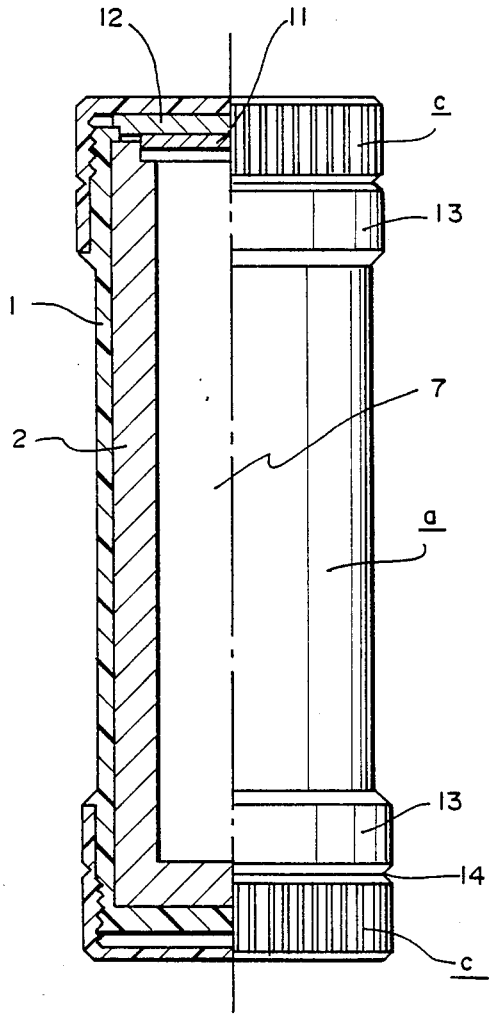
FIG. 8 is a partial sectional view of the radiation-shielding container with the top and bottom caps attached thereto by the screwed or threading method.

In the foregoing description, the engagement of the top cap and the bottom cap is illustrated with reference to the snap-in method (FIG. 7) or a screw or threading method (FIG. 8). However, the modification therefrom can be admitted as long as it is included within the scope of the invention. For instance, both caps can be a snap-on type or a screwed or threading type, or the top cap can be a screwed or threading type and the bottom cap can be a snap-on type.

What is claimed is:

1. A radiation-shielding container, comprising:

an outer plastic tube;

an inner radiation-shielding metal tube inserted into said outer tube so that the assembled tubes are substantially longitudinally co-extensive;

a top, plastic cap mounted at one end of said assembled tubes to close said end, said top plastic cap having a skirt portion;

a plug of radiation-shielding metal mounted within said top plastic cap; and a bottom plastic cap mounted at the other end of said assembled tubes to close said other end, said bottom plastic cap having a skirt portion.

wherein both said top and bottom plastic caps can only be removed from said assembled tubes by irretrievably severing said skirt portions from said caps.

2. The radiation-shielding container according to claim 1, wherein the top and bottom caps have a curved wall, and wherein the skirt portions are bounded by a notched thin portion on the curved wall of the top and bottom caps, and are severable through said notched thin portions when said caps are removed.

3. The radiation-shielding container according to claim 1, wherein the top and bottom caps are attached to the outer plastic tube by a snap-on method.

4. The radiation-shielding container according to claim 1, wherein the top and bottom caps are attached to the outer plastic tube by a screwed method.

5. The radiation-shielding container according to claim 1, wherein the top cap is attached to the outer plastic tube by a screwed method and the bottom cap is attached to the tube by a snap-on method.

6. The radiation-shielding container according to claim 1, wherein the top cap is attached to the outer plastic tube by a snap-on method and the bottom cap by a screwed method.

* * * * *